US008389186B2

(12) United States Patent
Mizobe

(10) Patent No.: US 8,389,186 B2
(45) Date of Patent: Mar. 5, 2013

(54) TONER SET, DEVELOPER SET, IMAGE FORMING APPARATUS, AND IMAGE FORMING METHOD

(75) Inventor: Takeo Mizobe, Osaka (JP)

(73) Assignee: Kyocera Mita Corporation (JP)

( * ) Notice: Subject to any disclaimer, the term of this patent is extended or adjusted under 35 U.S.C. 154(b) by 317 days.

(21) Appl. No.: 12/909,270

(22) Filed: Oct. 21, 2010

(65) Prior Publication Data

US 2011/0097656 A1 Apr. 28, 2011

(30) Foreign Application Priority Data

Oct. 26, 2009 (JP) ..... 2009-245351

(51) Int. Cl.
*G03G 9/08* (2006.01)

(52) U.S. Cl. ..... 430/108.7; 430/107.1; 430/108.1; 430/108.24; 430/108.6; 430/110.4; 399/222

(58) Field of Classification Search ..... 430/107.1, 430/108.1, 108.24, 108.6, 110.4, 108.7; 399/222
See application file for complete search history.

(56) References Cited

U.S. PATENT DOCUMENTS

2002/0021913 A1 2/2002 Nakamura et al.
2005/0089779 A1 * 4/2005 Matsumoto et al. ..... 430/45

FOREIGN PATENT DOCUMENTS

JP 2002-23459 1/2002

* cited by examiner

*Primary Examiner* — Peter Vajda
(74) *Attorney, Agent, or Firm* — Gerald E. Hespos; Michael J. Porco; Matthew T. Hespos

(57) ABSTRACT

A toner set is composed of toners of a plurality of colors that are used in a tandem-type color image forming apparatus. Each of the toners of a plurality of colors includes toner base particles and an external additive. The external additive includes small-diameter silica particles and large-diameter silica particles larger than the small-diameter silica particles. When, of the toners of a plurality of colors, three color toners to be used consecutively for forming the toner image are defined as a first toner, second toner and third toner respectively in order of usage thereof, the average particle diameter of the large-diameter silica particles contained in the second toner is smaller than the average particle diameter of the large-diameter silica particles contained in the first toner and is larger than the average particle diameter of the large-diameter silica particles contained in the third toner.

6 Claims, 1 Drawing Sheet

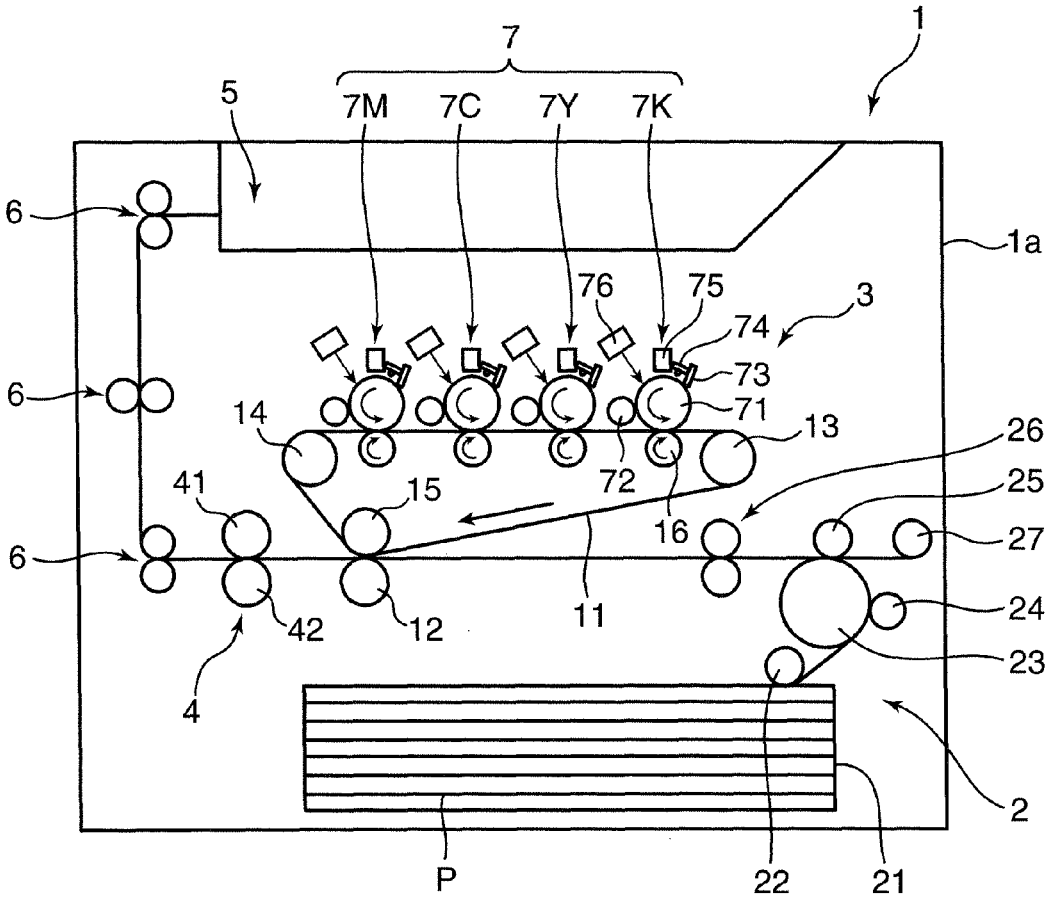
1
7
5
7M
7C
7Y
7K
6
1a
76
75
3
74
73
6
14
71
13
26
41
15
72
25
16
27
6
42
12
11
24
23
4
2
P
22
21

TONER SET, DEVELOPER SET, IMAGE FORMING APPARATUS, AND IMAGE FORMING METHOD

BACKGROUND OF THE INVENTION

1. Field of the Invention

The present disclosure relates to a toner set, developer set, image forming apparatus, and image forming method.

2. Description of the Related Art

A copy machine, a printer, a fax machine, a combined machine thereof, and other image forming apparatus using an electrophotographic system have an image bearing member, a charging device for charging a surface of the image bearing member uniformly, an exposure device for forming an electrostatic latent image on the image bearing member, a developing device for developing the electrostatic latent image on the image bearing member to a toner image, and a transfer device for transferring the toner image on the image bearing member onto a recording medium. This image forming apparatus uses each of these devices to transfer the toner image onto a recording medium as described above, to form an image on the recording medium.

Such an image forming apparatus has not only a function for printing in black and white, but also a color printing function for printing color images. Specifically, there is used an image forming apparatus with a single photosensitive drum, such as a single-drum type color copy machine or multi-functional peripheral (MFP). However, when printing a color image on a single sheet, this kind of single-drum type image forming apparatus needs to form the image on the photosensitive drum serving as an image bearing member, each time toner images of black, yellow, cyan, magenta and the like are formed. The problem here, therefore, is that the printing speed for performing the color printing is approximately ¼ of the printing speed for performing black-and-white printing. In other words, color printing takes approximately four times longer than black-and-white printing. For this reason, the image forming apparatus with a color printing function is required to reduce the print time or, in other words, to increase the printing speed. Examples of image forming apparatuses that satisfy such requirements include a tandem-type color image forming apparatus.

Tandem-type color image forming apparatus has, for example, an intermediate transfer belt, to the surface of which a toner image formed on an image bearing member by an electrophotographic system is transferred primarily, and which secondarily transfers the primarily transferred toner image onto a transfer material such as a sheet. In other words, in the tandem-type color image forming apparatus, toner images of yellow (Y), magenta (M), cyan (C), and black (K) are primarily transferred successively onto the intermediate transfer belt to form toner images having a plurality of toner colors on the surface of the intermediate transfer belt, and the toner images having the plurality of toner colors are secondarily transferred onto the transfer material such as a sheet, whereby a color image is formed. In such an image forming apparatus, image forming units corresponding to the respective colors are arranged along the intermediate transfer belt in order to primarily transfer the toner images of these colors successively. The toner images of the four colors, YMCK, formed on the photosensitive drums of the respective image forming units are transferred successively (primary transfer), whereby color toner images composed of the toners, each having one of the plurality of colors are formed. The color toner images on the intermediate transfer belt, which are composed of the toners of the plurality of colors, are transferred onto the transfer material, such as a sheet, by a secondary transfer roller installed facing the intermediate transfer belt (secondary transfer). As a result, a color image is formed on the transfer material such as a sheet. In this manner, the toner images corresponding to the respective colors are formed on the image bearing members of the image forming units corresponding to the respective colors, and these toner images are successively transferred on the intermediate transfer belt. Subsequently, the color toner images composed of the toners of the plurality of colors are formed on the intermediate transfer belt and then transferred onto the transfer material such as a sheet, to form a color image. Therefore, the tandem-type color image forming apparatus realizes high-speed printing.

The image forming apparatus that uses the toners of a plurality of colors to form a color image, as described above, has a problem in which, although a color image is formed unlike the image forming apparatus that forms a single-colored image using a single-color toner, it is difficult to form an image with good quality. More specifically, the formed image tends to become, for example, uneven and dry. Moreover, a so-called defective image, which is an image with defects, is easily formed. This problem where a favorable image cannot be formed easily is particularly prominent when using an image forming method, e.g., the tandem-type color image forming apparatus, which forms an image by forming color toner images of the plurality of toners onto an intermediate transfer unit once and then transferring the formed toner images onto a recording medium.

Such a color image forming apparatus is an image forming apparatus for stacking visible images on an image transfer medium to form a color image, the image forming apparatus having an image forming unit that has, for example: a plurality of toner supply means for supplying different types of toners; at least one visible image forming means (developing means) for forming visible images with the toners on image forming media (photosensitive drums); and transfer means for transferring the visible images onto an image transfer medium (recording medium) while bringing the visible images into contact with the image transfer medium, wherein each of the toners accommodated in the plurality of toner supply means respectively includes an external additive, and when additive amounts Sn of the external additives contained in the toner within the respective toner supply means are represented by S1, S2, S3, S4, . . . . Sn sequentially in this order from an upstream side in a moving direction of a transfer material, S1>S2>S3>S4> . . . >Sn is established. It is expected that such an example can prevent the occurrence of a so-called reverse transfer phenomenon where, when a transfer step of stacking the toners on a sheet to form images is carried out before transferring the toner images, the toners adhere to the photosensitive drums.

SUMMARY OF THE INVENTION

An object of the present disclosure is to provide a toner set composed of toners of a plurality of colors, which is capable of preventing the occurrence of uneven transfer and defective images to form favorable images. Another object of the present disclosure is to provide a developer set composed of a plurality of developers containing toners of the plurality of colors of the toner set and carriers, an image forming apparatus that uses the developers of the developer set, and an image forming method that uses the developers of the developer set.

One aspect of the present disclosure for accomplishing these objects is a toner set, which is composed of toners of a plurality of colors that are used in an image forming method for forming an image by forming a color toner image using the toners of a plurality of colors and transferring the formed toner image onto a recording medium, wherein each of the toners of a plurality of color includes toner base particles that contain a binder resin and a colorant, as well as an external additive that is externally added to the toner base particles, the external additive includes small-diameter silica particles and large-diameter silica particles larger than the small-diameter silica particles, and wherein when, of the toners of a plurality of colors, three color toners to be used consecutively for forming the toner image are defined as a first toner, second toner and third toner respectively in order of usage, an average particle diameter of the large-diameter silica particles contained in the second toner is smaller than an average particle diameter of the large-diameter silica particles contained in the first toner and is larger than an average particle diameter of the large-diameter silica particles contained in the third toner.

Another aspect of the present disclosure is a developer set, which is composed of developers of a plurality of colors, wherein the developers of a plurality of colors have developer containing the first toner of the toner set and carrier, developer containing the second toner of the toner set and carrier, and developer containing the third toner of the toner set and carrier.

Yet another aspect of the present disclosure is an image forming apparatus, which has a plurality of image bearing members that are arranged in a predetermined direction in order to form a toner image by means of toners of different colors onto surfaces of the plurality of image bearing members, and a plurality of developing devices that are disposed facing the image bearing members respectively and supply the toners included in developers to the surfaces of the image bearing members, wherein the developers of the developer set is employed as the developers to be used in the plurality of developing devices.

Yet another aspect of the present disclosure is an image forming method, which has a step of forming a toner image by means of toners different colors onto surfaces of a plurality of image bearing members arranged in a predetermined direction, by supplying, to the surfaces of the image bearing members, the toners that are included in developers accommodated in a plurality of developing devices that are disposed facing the image bearing members respectively, wherein the developers of the developer set are employed as the developers accommodated in the plurality of developing devices.

BRIEF DESCRIPTION OF THE DRAWINGS

FIG. 1 is a schematic cross-sectional diagram showing the entire configuration of an image forming apparatus used in the present embodiment.

DETAILED DESCRIPTION OF THE PREFERRED EMBODIMENTS

The inventor of the present disclosure has speculated that it is difficult to form a favorable image with a color image forming apparatus due to the following reasons.

It is considered that, because toner images of the toners of a plurality of colors that correspond to a color image are formed by sequentially transferring the toners of a plurality of colors onto an intermediate transfer belt (primary transfer), there is a difference in the number of times the pressure is applied to the toner images corresponding to the respective colors. In other words, the number of times that the toner image that is transferred first onto the intermediate transfer belt is applied with the pressure is more, whereas the number of times that the toner that is transferred last onto the intermediate transfer belt is applied with the pressure is less.

Specifically, here is described an example in which a tandem-type color image forming apparatus is used. A toner image that is transferred to an intermediate transfer belt is applied with the pressure each time a toner image of a different color is transferred. Therefore, the order in which the toner images are transferred to the intermediate transfer belt makes a difference in adhesion between the intermediate transfer belt and the toner images transferred to the intermediate transfer belt. For this reason, highly adhesive toner images are unlikely to be transferred to a recording medium. In other words, depending on the toner images, the transferability of the toner image in the second transfer (secondary transfer) might be lowered. This is why it is considered difficult to form a favorable image.

Furthermore, according to the example of the color image forming apparatus mentioned above, it is expected that such an example can prevent the occurrence of a so-called reverse transfer phenomenon where, when a transfer step of stacking the toners on an intermediate transfer belt to form images is carried out before transferring the toner images, the toners adhere to the photosensitive drums. The fluidity of each toner increases by increasing the amount of the external additive such as silica. Therefore, by adding more of the external additive to the toner that is transferred initially, the expectation described above is considered to fix the problem where it is difficult to form a favorable image using a color image forming apparatus that uses the toners of a plurality of colors to form a color image, as described above.

However, the inventor of the present disclosure speculates that, although the toner fluidity increases by increasing the amount of the external additive, there is a limitation in improvement of the fluidity that can be achieved by increasing the amount of the external additive. Moreover, if the amount of the external additive is increased, the amount of the external additive that has escaped from the toner base particles increases, whereby the amount of the external additive adhering to the intermediate transfer belt increases. Consequently, when cleaning the intermediate transfer belt to remove transfer residual toner when the intermediate transfer belt has a relatively large amount of external additive adhered thereto, the pressure applied by a cleaning device such as a cleaning blade and the pressure applied by the photosensitive drums during the transfer might damage the intermediate transfer belt. In addition, the external additive that has escaped from the toner base particles adheres to a recording medium, causing white spots in an image such as a solid image.

The present disclosure has been contrived in view of the above circumstances, and an object thereof is to provide a toner set composed of toners of a plurality of colors, which is capable of preventing the occurrence of uneven transfer and defective images to form favorable images. Another object is to provide a developer set composed of the toners of the toner set and carriers, an image forming apparatus that uses the developers of the developer set.

Embodiments according to the present disclosure are described hereinafter, but the present disclosure is not limited thereto.

[Toner Set]

A toner set according to the present embodiment is a toner set that is composed of toners of a plurality of colors used in an image forming method that forms a color toner image by using toners of a plurality of colors and then transferring the formed toner image onto a recording medium. Note that toners of a plurality of colors in the toner set include toners of three or more colors.

In the toner set, each of toners of a plurality of colors includes toner base particles that contains a binder resin and a colorant, as well as an external additive that is externally added to the toner base particles, the external additive including small-diameter silica particles and large-diameter silica particles larger than the small-diameter silica particle, and when, of the toners of a plurality of colors, three color toners to be used consecutively for forming the toner image are defined as a first toner, second toner and third toner respectively in order of usage, an average particle diameter of the large-diameter silica particles contained in the second toner is smaller than an average particle diameter of the large-diameter silica particles contained in the first toner and is larger than an average particle diameter of the large-diameter silica particles contained in the third toner. Note that the order in which the toners are used for forming the toner images is synonymous with the order in which the toner images formed using the toners are transferred to an intermediate transfer belt.

Specifically, in the toner set, when forming color toner images with toners of a plurality of colors by transferring the toner images to the intermediate transfer belt in order of, for example, a magenta toner, cyan toner, yellow toner, and black toner, the particle diameters of the large-diameter silica particles contained in the respective toners decrease stepwise. In other words, while the large-diameter silica particles contained in the magenta toner is the largest, the large-diameter silica particles contained in the black toner is the smallest. The particle diameter of the small-diameter silica particles is smaller than that of the smallest large-diameter silica particles.

Using the toner set can prevent the occurrence of uneven transfer and defective images, to form favorable images.

<Toner>

As described above, each of the toners includes toner base particles containing a binder resin and a colorant, as well as an external additive that is externally added to the toner base particles.

(External Additive)

As described above, each of the toner is obtained by externally adding its external additive to the toner base particles, which is described hereinafter. In other words, the toner base particles are subjected to an external addition treatment. As the external addition treatment, any conventional external addition treatment can be used. Specifically, the external addition treatment is, for example, a step of adding the external additive to the toner base particles and agitating it using an agitator or the like to attach or fix the external additive to the surface of the toner base particles.

The external additive includes the small-diameter silica particles and the large-diameter silica particles larger than the small-diameter silica particles, but is not particularly limited thereto as long the particle diameters of these silica particles satisfy the relationship described above.

Also, it is preferred that the relationship of particle diameter between the small-diameter silica particles and the large-diameter silica particles in each toner satisfy the following expression (1).

$$30 \leqq N_2 - N_1 \leqq 60 \quad (1)$$

In this expression, $N_1$ represents an average primary particle diameter (nm) of the small-diameter silica particles, and $N_2$ represents an average primary particle diameter (nm) of the large-diameter silica particles. The average primary particle diameter $N_1$ of the small-diameter silica particles and the average primary particle diameter of the large-diameter silica particles $N_2$ are a volume-average diameter, which can be measured by using a commonly used particle size analyzer, such as Beckman Coulter's particle size analyzer (Multisizer 3, manufactured by Beckman Coulter Inc.).

If the difference in particle diameter between the large-diameter silica particles and the small-diameter silica particles ($N_2-N_1$) is excessively small, the effect of enhancing the secondary transferability is unlikely to be exerted, and void (central blurs) tends to be generated easily in a formed image such as a thin line image. If, on the other hand, the difference in particle diameter ($N_2-N_1$) is excessively large, the small-diameter silica particles tends to function as a spacer for preventing the toner base particles from coming into contact with each other, and the large-diameter silica particles tends to escape from the toner base particles. Another problem is that when the large-diameter silica particles escapes from the toner base particles, the pressure applied during a cleaning process for removing transfer residual toner or the pressure applied by a photosensitive drum during the transfer attaches the large-diameter silica particles to the intermediate transfer belt or photosensitive drum, causing white spots in an image such as a solid image. Another problem is that the large-diameter silica particles that has escaped from the toner base particles adheres to the recording medium, causing white spots in an image such as a solid image. For this reason, it is considered that, if the expression (1) is satisfied, a favorable difference is obtained between the large-diameter silica particles and the small-diameter silica particles and that, consequently, the large-diameter silica particles and the small-diameter silica particles both can have favorable particle diameters. Such difference in particle diameter can accomplish the enhancement of the capabilities exerted by the small-diameter silica particles, which are, specifically, the toner fluidity, primary transferability, development properties and the like, as described above, as well as the capability exerted by the large-diameter silica particles, which is the secondary transferability in particular.

The average primary particle diameter of the small-diameter silica particles may satisfy the relationship of difference between the diameter of the large-diameter silica particles and the diameter of the small-diameter silica particles ($N_2-N_1$), and is preferably less than 30 nm or, more preferably, to 20 nm. If the small-diameter silica particles are excessively small, the primary transferability is degraded, whereby void (central blurs) tends to be generated easily in a formed image such as a thin line shape image. If the small-diameter silica particles are excessively large, the effect of enhancing the fluidity cannot be exerted satisfactorily, and, as a result, a formed image cannot be obtained adequate image density.

The average primary particle diameter of the large-diameter silica particles may satisfy the relationship of difference between the diameter of the large-diameter silica particles and the diameter of the small-diameter silica particles ($N_2-N_1$), and is preferably at least 30 nm, or, more preferably, 40 to 60 nm. If the large-diameter silica particles are excessively small, the effect of enhancing the secondary transferability cannot be exerted, whereby void (central blurs) tends to be generated easily in a formed image such as a thin line shape image. If the large-diameter silica particles are excessively large, the small-diameter silica particles tend to function as a spacer for preventing the toner base particles from coming into contact with each other, and the large-diameter silica particles tend to escape from the toner base particles. Another problem is that when the large-diameter silica particles escape from the toner base particles, the pressure applied during the cleaning process for removing transfer residual toner or the pressure applied by a photosensitive drum during the transfer attaches the large-diameter silica particles to the intermediate transfer belt or photosensitive drum, causing white spots in an image such as a solid image. Another problem is that the large-diameter silica particles that has escaped from the toner base particles adhere to the recording medium, causing white spots in an image such as a solid image.

It is also preferred that the content of the small-diameter silica particles within each toner satisfy the following expression (2).

$$0.7 \leqq C_1R/N_1 \leqq 1 \quad (2)$$

In this expression, $N_1$ represents an average primary particle diameter (nm) of the small-diameter silica particles, R represents an average particle diameter (μm) of the toner base particles, and $C_1$ represents a mass of the small-diameter silica particles with respect to 100 parts by mass of the toner base particles. As with average primary particle diameter $N_1$ of the small-diameter silica particles and the average primary particle diameter of the large-diameter silica particles $N_2$, the average particle diameter R of the toner base particles is a volume-average diameter, which can be measured by using a general particle size analyzer, such as Beckman Coulter's particle size analyzer (Multisizer 3, manufactured by Beckman Coulter Inc.).

Excessively low content of the small-diameter silica particles causes a degradation of the development properties, and, as a result, a formed image cannot be obtained adequate image density. If the content of the small-diameter silica particles is excessively high, toner scattering and fogging cannot be prevented, and white spots are formed easily in an image such as a solid image. For this reason, it is considered that, if the expression (2) is satisfied, a favorable content of the small-diameter silica particles in the relationship between the average particle diameter of the toner base particles and the average primary particle diameter of the small-diameter silica particles can be obtained. As a result, the capabilities of the small-diameter silica particles can be exerted satisfactorily while preventing the occurrence of problems that are likely to happen when a large amount of small-diameter silica particles is contained.

It is preferred that the content of the large-diameter silica particles within each toner satisfy the following expression (3).

$$0.05 \leqq C_2R/N_2 \leqq 0.15 \quad (3)$$

In this expression, $N_2$ represents an average primary particle diameter (nm) of the large-diameter silica particles, R represents an average particle diameter (μm) of the toner base particles, and $C_2$ represents a mass of the large-diameter silica particles with respect to 100 parts by mass of the toner base particles.

If the content of the large-diameter silica particles is excessively low, the effect of enhancing the secondary transferability cannot be exerted, whereby void (central blurs) tends to be generated easily in a formed image such as a thin line shape image. If the content of the large-diameter silica particles is excessively high, the large-diameter silica particles tend to escape from the toner base particles. When the large-diameter silica particles escape from the toner base particles, the pressure applied during the cleaning process for removing the transfer residual toner or the pressure applied by a photosensitive drum during the transfer attaches the large-diameter silica particles to the intermediate transfer belt or the photosensitive drum, causing white spots in an image such as a solid image. Another problem is that the large-diameter silica particles that has escaped from the toner base particles adheres to the recording medium, causing white spots in an image such as a solid image. For these reason, it is considered that, if the expression (3) is satisfied, a favorable content of the large-diameter silica particles in the relationship between the average particle diameter of the toner base particles and the average primary particle diameter of the large-diameter silica particles can be obtained. As a result, the capabilities of the large-diameter silica particles can be exerted satisfactorily while preventing the occurrence of problems that are likely to happen when a large amount of large-diameter silica particles is contained.

In this manner, satisfying the inequalities (1) to (3) described above in each toner can achieve the toner set composed of toners of a plurality of colors, which can prevent uneven transfer and defective images to form favorable images.

Moreover, the external additive may include an external additive other than the silica particles such as the small-diameter silica particles and the large-diameter silica particles. The external additives other than the silica particles are not particularly limited as long as they can be used as external additives for the toners. Specifically, examples include titanium-oxide particles, alumina particles, and magnetite particles. In addition, as the external additives other than the silica particles, the external additive described above may be used independently or a combination of two or more of the external additives may be used.

As the agitator used in the external addition treatment mentioned above, a conventionally known agitator can be used. Specifically, examples include the general agitators such as a turbine type agitator, Henschel mixer, and super mixer.

(Toner Base Particles)

As described above, although not particularly limited, the toner base particles that include a binder resin and a colorant may be in any form as long as it can be used as the toner base particles. It is preferred that the toner base particle be a sphere. Although not particularly limited as long as the inequalities (2) and (3) are satisfied, the particle diameter thereof is preferably a volume-average diameter of 3 to 9 μm.

(Binder Resin)

As the binder resin, any binder resin can be used as a conventional binder resin for toner base particles. Examples include polystyrene resins such as styrene-acrylic copolymer and styrene-butadiene resin; acrylic resins; polyethylene resin; polypropylene resins; vinyl chloride resins; polyester resins; polyamide resins; polyurethane resins; polyvinyl alcohol resins; vinyl ether resins; and N-vinyl resins. Above all, preferably used are polyester resins due to their excellent low temperature fixability and wide anti-offsetting temperature range. Each of the binder resins may be used independently as the binder resin, or a combination of two or more of the binder resins may be used.

Examples of the polyester resins include the one that is obtained by condensation polymerization or co-condensation polymerization of the alcohol component and a carboxylic acid component. The following components can be used as the components used for synthesizing the polyester resins.

The alcohol component is not particularly limited as long as it can be used as the alcohol component for synthesizing the polyester resins. Furthermore, the alcohol component needs to include alcohol that has two or more hydroxyl groups (dihydric or higher polyhydric alcohol) in a molecule. Specifically, examples of the dihydric alcohol used as the alcohol component include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol; and bisphenols such as bisphenol A, hydrogenated bisphenol A, polyoxyethylenated bisphenol A, and polyoxypropylenated bisphenol A. Examples of trihydric or higher alcohol used as the alcohol component include, specifically, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-tri hydroxymethyl benzene. Each of the abovementioned alcohol components may be used independently as the alcohol component, or a combination of two or more of these components may be used.

The carboxylic acid component is not particularly limited as long as it can be used as the carboxylic acid for synthesizing the polyester resins. The carboxylic acid component includes not only carboxylic acid but also acid anhydride or lower alkyl ester of the carboxylic acid. The carboxylic component needs to include carboxylic acid having two or more carboxyl groups (dicarboxylic or higher polycarboxylic acid) in a molecule. Examples of dicarboxylic acid used as the carboxylic acid include, specifically, maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkyl succinic acid, and alkenyl succinic acid. Examples of alkyl succinic acid include n-butyl succinic acid, isobutyl succinic acid, n-octyl succinic acid, n-dodecyl succinic acid, and iso-dodecyl succinic acid. Examples of alkenyl succinic acid include n-butenyl succinic acid, isobutenyl succinic acid, n-octenyl succinic acid, n-dodecenyl succinic acid, and iso-dodecenyl succinic acid. Examples of trihydric or higher polycarboxylic acid used as the carboxylic acid include, specifically, 1,2,4-benzene-tricarboxylic acid (trimellitic acid), 1,2,5-benzen-tricarboxylic acid, 2,5,7-naphthalene-tricarboxylic acid, 1,2,4-naphthalene-tricarboxylic acid, 1,2,4-butane-tricarboxylic acid, 1,2,5-hexane-tricarboxylic acid, 1,3-dicarboxy-2-methyl-2-methylene carboxy propane, 1,2,4-cyclohexane-tricarboxylic acid, tetra (methylene carboxyl)methane, 1,2,7,8-octanetetracarboxylic acid, pyromellitic acid, and empol trimer acid. Each of the abovementioned carboxylic acid components may be used independently as the carboxylic component, or a combination of two or more of these components may be used.

The polystyrene resins may be a homopolymer of styrene or a copolymer of styrene and other copolymerized monomer that is copolymerizable with styrene. Examples of the copolymerized monomer include p-chlorostyrene; vinylnaphthalene; olefinic hydrocarbons (alkene) such as ethylene, propylene, butylene, and isobutylene; vinyl halide such as vinyl chloride, vinyl bromide, and vinyl fluoride; vinyl esters such as vinyl acetate, vinyl propionate, vinyl benzoate, and vinyl butyrate; acrylic esters such as methyl acrylate, ethyl acrylate, n-butyl acrylate, isobutyl acrylate, dodecyl acrylate, n-octyl acrylate, 2-chloro-ethyl acrylate, phenyl acrylate, and α-chloroacrylate methyl; methacrylate esters such as methyl methacrylate, ethyl methacrylate, and butyl methacrylate; acrylic acid derivatives of acrylate such as acrylonitrile, methacrylonitrile, and acrylamide; vinyl ethers such as vinyl methyl esters and vinyl isobutyl ether; vinyl ketones such as vinyl methyl ketone, vinyl ethyl ketone, and methyl isopropenyl ketone; and N-vinyl compounds such as N-vinyl pyrrole, N-vinylcarbazole, N-vinyl indole, and N-vinyl pyrrolidene. Above all, the acrylic esters are preferred due to their excellent low temperature fixability, charge stability, and environmental stability, and the n-butyl acrylate is particularly preferred. As the copolymerized monomer, each of the abovementioned monomers may be used independently, or a combination of two or more of these monomers may be used. It is preferred that the polystyrene resins have two weight-average molecular weight peaks (low-molecular weight peak and high-molecular weight peak). Specifically, it is preferred that the low-molecular weight peak be in the range of 3000 to 20,000 and that the high-molecular weight peak be in the range of 300,000 to 1500,000. Moreover, as to the weight-average molecular weight (Mw) and number average weight molecular weight (Mn), Mw/Mn is preferably 10 or above. As long as the weight-average molecular weight peak is within this range, not only is it possible to fix the toner easily, but also the offset resistance can be improved.

As the binder resin, it is preferred to use the abovementioned thermoplastic resins, but any of the thermoplastic resins does not have to be used alone. A cross linker or thermosetting resin may be combined with any of the thermoplastic resins. By introducing a partial cross linking structure into the binder resin, the preservation stability, shape retentive property, and durability of the toner can be improved while preventing the deterioration of fixability.

(Colorant)

A known pigment or dye can be used as the colorant so as to obtain a desired color in each toner. Specifically, examples include the following colorants depending on the colors. Examples of a black pigment include acetylene black, lampblack, aniline black, and other carbon black. Examples of a yellow pigment include chrome yellow, zinc yellow, cadmium yellow, yellow iron oxide, mineral fast yellow, nickel titanium yellow, navels yellow, naphthol yellow S, Hansa yellow G, Hansa yellow 10G, benzidine yellow G, benzidine yellow GR, quinoline yellow lake, permanent yellow NCG, tartrazine lake, C. I. pigment yellow 180 and the like. Examples of an orange pigment include chrome orange, molybdenum orange, permanent orange GTR, pyrazolone orange, Vulcan orange, Indanthrene brilliant orange RK, benzidine orange G, Indanthrene brilliant orange GK, and the like. Examples of a red pigment include colcothar, cadmium red, red lead, mercury sulfide cadmium, permanent red 4R, lithol red, pyrazolone red, watching red calcium salt, lake red D, brilliant carmine 6B, eosin lake, rhodamine lake B, alizarin lake, brilliant carmine 3B, C. I. pigment 238, and the like. Examples of a violet pigment include manganese violet, fast violet B, methyl violet lake, and the like. Examples of a blue pigment include prussian blue, cobalt blue, alkali blue lake, victoria blue lake, phthalocyanine blue, metal-free phthalocyanine blue, phthalocyanine blue-partial chlorination product, first sky blue, Indanthrene blue BC, C. I. pigment blue 15:3 (copper phthalocyanine blue pigment), and the like. Examples of a green pigment include chrome green, chrome oxide, pigment green B, malachite green lake, Fanal yellow green G, and the like. Examples of a white pigment include Chinese white, titanic oxide, antimony white, zinc sulfide, baryta powder, barium carbonate, clay, silica, white carbon, talc, alumina white, and the like. The C. I. pigment blue 15:3 (copper phthalocyanine blue pigment) is preferred as, for example, the colorant for the cyan toner.

The additive amount of the colorant is generally 1 to 10 parts by mass with respect to 100 parts by mass of the binder resin so that favorable image density can be achieved, but is preferably 3 to 7 parts by mass.

(Wax)

The toner base particles generally contain wax for improving the fixability and offset property. As the wax, any wax can be used as a conventional wax for toner base particles. Specifically, examples include plant-based waxes such as carnauba wax, sugar cane wax, and wood wax; animal waxes such as honey wax, insect wax, whale wax, and wool wax; and synthetic hydrocarbon waxes such as Fischer Tropsch (described as "FT" hereinafter) wax, polyethylene wax, and polypropylene wax. Above all, the FT wax and carnauba wax are preferred due to their excellent dispersibility within the binder resin, and the carnauba wax is particularly preferred. The additive amount of the wax is preferably 0.5 to 10 parts by mass with respect to 100 parts by mass of the binder resin, but adding 1 to 5 parts by mass of the wax is particularly preferred. When the additive amount is excessively low, the effects obtained by adding the wax tend to not be satisfactory. When, on the other hand, the additive amount is excessively high, anti-blocking properties deteriorate, and the wax might escape from the toner.

(Charge-Controlling Agent)

The toner base particles generally contains a charge-controlling agent for improving the charging properties. As the charge-controlling agent, any charge-controlling agent can be used as a conventional charge-controlling agent for toner base particles. Specifically, examples include charge-controlling agents exhibiting positive charge properties, such as a nigrosine compound, quaternary ammonium salt compound, and resin type charge-controlling agent obtained by combining a resin with an amine compound, and a charge-controlling resin. In addition, the additive amount of the charge-controlling agent is preferably 0.5 to 20 parts by mass with respect to 100 parts by mass of the binder resin, and is more preferably 1 to 5 parts by mass. When the additive amount of the charge-controlling agent is excessively low, it becomes difficult to stably charge the toner to a predetermined polarity, easily causing fogging. When, on the other hand, the additive amount of the charge-controlling agent is excessively high, the environmental resistance deteriorates easily, and particularly toner charging failure occurs easily under high temperature/high humidity circumstances. As a result, image failure, contamination of the photoreceptors, and other problems occur easily.

(Production Method)

Moreover, although not particularly limited, the toner base particles can be produced by the following methods.

First of all, each of the components of the toner base particles, such as the binder resin and a colorant, are mixed using a mixing machine. A known mixing machine can be used as the mixing machine, and examples thereof include Henschel-type mixing apparatuses such as a Henschel Mixer™, super mixer and Mechanomill, Ongumill™, hybridization system, Cosmosystem™, and the like.

Next, a kneading machine is used for melting and kneading thus obtained mixture. A known kneading machine can be used as the kneading machine, and examples thereof include a twin-screw extruder, triple roll mill, and laboratory mill. The twin-screw extruder is favorably used. The temperature of the obtained mixture, when melting and kneading the mixture, is preferably equal to or higher than the softening point of the binder resin but less than the pyrolysis temperature of the binder resin.

Next, the molten and kneaded product obtained as above is cooled to a solid product, which is then pulverized with a pulverizer. A known pulverizer can be used as this pulverizer, and examples thereof include air stream pulverizers such as a jet pulverizer (jet mill) for pulverizing using an ultrasonic jet air stream, mechanical pulverizers such as a turbo mill, and impact pulverizers. A jet pulverizer, especially a jet mill, is favorably used.

Finally, thus obtained pulverized product is sorted by a classifier and the like. Sorting the pulverized product can remove the excess pulverized products and course powder so that desired toner base particles can be obtained. A known classifier can be used as the classifier, and examples thereof include wind power classifiers such as an elbow jet and other whirl type wind power classifiers (rotary-type wind power classifiers), as well as centrifugal classifiers.

[Developer Set]

A developer set that has the toners of the respective colors configuring the toner set is composed of developers of a plurality of colors. The developers of a plurality of colors may each be one-component developers that include the toners of the respective colors configuring the toner set and do not include carrier, or may be two-component developers that include both the toners of the respective colors and carrier. However, the developer set composed of the two-component developers is favorably used. In other words, the developer set is preferably a developer set that is composed of a plurality of developers that have developer containing the first toner of the toner set and carrier, developer containing the second toner of the toner set and carrier, and developer containing the third toner of the toner set and carrier. The developer set here is not limited to the one composed of the three colors of the developers, but may be a set of four or more developers in which each of developer includes one of four or more toners and carriers respectively as long as the relationships described above are satisfied by three consecutive toners used for forming the toner images. That is to say, the developer set here is composed of a plurality of colors of developers, wherein each of the plurality of developers may contain the corresponding toner of a plurality of colors configuring the toner set and carrier. Specifically, regarding the developer set composed of the two-component developers, when the toner set is composed of the four colors of toners such as a magenta toner, cyan toner, yellow toner and black toner, the developer set is configured by a magenta developer containing the magenta toner and carrier, a cyan developer containing the cyan toner and carrier, a yellow developer containing the yellow toner and carrier, and a black developer containing the black toner and carrier. In such a developer set, the toners of the respective colors that configure the toner set are contained in the respective developers. In other words, the three consecutive colors of toners that are used for forming the toner images include the toners satisfying the relationships described above. Therefore, this developer set composed of the developers of a plurality of colors can prevent the occurrence of uneven transfer and defective images to form favorable images.

(Carrier)

As the carrier, any carrier can be used as the carrier for the developer. Specifically, examples include carrier having the surface of carrier core material (magnetic particles) coated with a resin, a ferrite carrier, and other magnetic particles.

Specifically, examples of the carrier core materials include magnetic metals such as iron, nickel and cobalt, an alloy thereof, alloys containing rare earths, soft ferrites such as hematite, magnetite, manganese-zinc-based ferrite, nickel-zinc-based ferrite, manganese-magnesium-based ferrite and lithium-based ferrite, iron-based oxides such as copper-zinc-based ferrite, and magnetic particles that are produced by sintering or atomizing a magnetic material of a mixture of the abovementioned elements.

As the surface coating agent for coating the surface of the carrier core material, any surface coating agent can be used for producing the carriers. Specifically, the examples thereof include fluorinated binder resins such as polytetrafluoroethylene, polychlorotrifluoroethylene and polyvinylidene fluoride, as well as silicone resins.

The particle diameter of each carrier is preferably in the range of 20 to 200 μm as measured generally by an electron microscope method, and more preferably in the range of 30 to 150 μm. It is preferred that the apparent density of the carrier be, although depending on the composition and/or a surface structure of the magnetic substance when the magnetic material is the main substance, generally 3000 to 8000 kg/m$^3$.

The toner density of each two-component developer containing the toner and carrier is 3 to 20 percent by mass, or preferably 4 to 15 percent by mass. If the toner density is excessively low, the image density of a formed image tends to be extremely low. If the toner density is excessively high, toner scattering occurs within the developing device, causing machine contamination and a problem where the toner undesirably adheres to a transfer sheet and other sections.

Each of the developers of the developer set according to the present embodiment is a two-component developer that is obtained by combining the corresponding toner and carrier in an appropriate ratio as described above, and can be used in, for example, the following image forming apparatus.

[Image Forming Apparatus and Image Forming Method]

An image forming apparatus that uses the toner set and developer set described above is an electrophotographic-type image forming apparatus, but not limited thereto as long as toners of a plurality of colors and developers are used in an image forming operation. Specifically, examples include a tandem-type color image forming apparatus that uses toners of a plurality of colors, as will be described hereinafter. Here is described the tandem-type color image forming apparatus. Note that the image forming apparatus according to the present embodiment has a plurality of image bearing members that are arranged in a predetermined direction in order to form toner images of the respective colors on surfaces of the plurality of image bearing members, and a plurality of developing devices that are disposed facing the image bearing members respectively and supply the toners included in developers to the surfaces of the image bearing members, wherein the developers used by the plurality of developing devices are the developers of the developer set described above.

An image forming method that uses the toner set and developer set described above is an electrophotographic-type image forming method, but not limited thereto as long as toners and developers of a plurality of colors are used in the image forming operation. Specifically, examples include an image forming method that uses the tandem-type color image forming apparatus in which toners of a plurality of colors are used, as will be described hereinafter. Note that the image forming method according to the present embodiment has a step of forming toner images of the different toner colors on the surfaces of the plurality of image bearing members arranged in the predetermined direction by supplying, to the surfaces of the image bearing members, toners that are included in the developers accommodated in the plurality of developing devices that are disposed facing the image bearing members, wherein the developers of the developer set described above are used as the developers accommodated in the plurality of developing devices.

FIG. 1 is a schematic cross-sectional diagram showing the entire configuration of an image forming apparatus 1. Here, a color printer 1 is described as an example of the image forming apparatus 1.

As shown in FIG. 1, the color printer 1 has a box-shaped apparatus main body 1*a*. On the inside the apparatus main body 1*a* is provided with a sheet feeding part 2 for feeding sheets P, an image forming part 3 for transferring an image to each sheet P while conveying the sheet P fed from the sheet feeding part 2, and a fixing part 4 for performing a fixation process on the image transferred to the sheet P by the image forming part 3. In addition, an upper surface of the apparatus main body 1*a* is provided with a sheet discharge part 5 to which the sheet P is discharged after being subjected to the fixation process by the fixing part 4.

The sheet feeding part 2 has a sheet cassette 21, pickup roller 22, sheet feeding rollers 23, 24, 25, and a resist roller pair 26. The sheet cassette 21, provided so as to be insertable to and removable from the apparatus main body 1*a*, stores the sheets P in different sizes. The pickup roller 22, provided in an upper-right position of the sheet cassette 21 as shown in FIG. 1, takes out, one by one, the sheets P stored in the sheet cassette 21. The sheet feeding rollers 23, 24, 25 send out the sheets P from the pickup roller 22 to a sheet conveying path. The resist roller pair 26 puts the sheet P on temporary standby, the sheet P being sent out to the sheet conveying path by the sheet feeding rollers 23, 24, 25, and thereafter supplies the sheet P to the image forming part 3 at a predetermined timing.

The sheet feeding part 2 further has a manual feed tray, not shown, and a pickup roller 27 that are mounted in a right-side surface of the apparatus main body 1*a*, as shown in FIG. 1. The pickup roller 27 takes out the sheet P placed on the manual feed tray. The sheet P taken out by the pickup roller 27 is sent to the sheet conveying path by the sheet feeding rollers 23, 25, put on temporary standby by the resist roller pair 26, and then supplied to the image forming part 3 at a predetermined timing.

The image forming part 3 has an image forming unit 7, an intermediate transfer belt 11, to a surface (contact surface) of which a toner image is primarily transferred by the image forming unit 7, and a secondary transfer roller 12 for secondarily transferring the toner image on the intermediate transfer belt 11 to the sheet P that is sent from the sheet feeding cassette 21.

The image forming unit 7 has a magenta unit 7M, cyan unit 7C, yellow unit 7Y and black unit 7K, which are disposed sequentially from the upstream side (the left-hand side in FIG. 1) to the downstream side in a moving direction of the intermediate transfer belt 11. At the center of each of the units 7M, 7C, 7Y and 7K, a photosensitive drum 71 functioning as the image bearing member is disposed so as to be rotatable in an arrow (counterclockwise) direction. Around the photosensitive drum 71 are disposed, from the upstream side of a direction of rotation of the photosensitive drum 71, a charger 75, exposure device 76, developing device 72, cleaning device 73, neutralizer 74 and the like. Note that examples of the photosensitive drum 71 include an amorphous silicon photoreceptor, a photosensitive layer of which contains amorphous silicon.

The charger 75 uniformly charges the circumferential surface of the photosensitive drum 71 rotating in the arrow direction. Examples of the charger 75 include a scorotron charger and the like.

The exposure device 76, so-called a laser scanning unit, irradiates the circumferential surface of the photosensitive drum 71 charged uniformly by the charger 75, with a laser beam based on image data that are input from an image reader or the like, and then forms an electrostatic latent image based on the image data, onto the photosensitive drum 71. The developing device 72 has developer housing part for accommodating developer. The developing device 72 forms the toner image based on the image data, onto the circumferential surface of the photosensitive drum 71, by supplying the toner of the developer accommodated in the developer housing part to the circumferential surface of the photosensitive drum 71 on which the electrostatic latent image is formed. The toner image is then primarily transferred to the intermediate transfer belt 11. Note that the developer housing part of the developing device 72 accommodates developer having different toner colors for each image forming unit 7. The cleaning device 73 cleans the toner that remains on the circumferential surface of the photosensitive drum 71 without getting transferred to the intermediate transfer belt 11, after the primary transfer of the toner image to the intermediate transfer belt 11 is completed. The neutralizer 74 neutralizes the circumferential surface of the photosensitive drum 71 after the primary transfer is completed. The circumferential surface of the photosensitive drum 71 that underwent the cleaning process by the cleaning device 73 and the neutralizer 74 moves toward the charger 75 for next charging process and is prepared to form a new image.

The intermediate transfer belt 11—an endless belt-type rotating unit—is wrapped around a plurality of rollers, such as a driving roller 13, belt supporting roller 14, backup roller 15, primary transfer rollers 16 and the like such that the surface (contact surface) of the intermediate transfer belt 11 abuts with the circumferential surface of each photosensitive drum 71. Also, the intermediate transfer belt 11 is rotated endlessly by the plurality of rollers while being pressed against the photosensitive drums 71 by the primary transfer rollers 16 that is disposed to face each photosensitive drum 71.

The driving roller 13 is driven to rotate by a drive source, such as a stepping motor, and thereby applies a drive force for endlessly rotating the intermediate transfer belt 11. The belt supporting roller 14 and backup roller 15, provided rotatably, are driven rollers that rotate as the intermediate transfer belt 11 is endlessly rotated by the driving roller 13. These driven rollers 14, 15 are passively rotated by means of the intermediate transfer belt 11 in response to the main rotation of the driving roller 13, and support the intermediate transfer belt 11.

The primary transfer rollers 16 apply a primary transfer bias (has a polarity opposite to the charge polarity of the toner) to the intermediate transfer belt 11. As a result, the toner images formed on the respective photosensitive drums 71 are sequentially transferred (primary transfer) between the primary transfer rollers 16 and the photosensitive drums 71 in a superimposed state on the intermediate transfer belt 11 that is caused to revolve in an arrow (clockwise) direction by the driving roller 13. Note that the primary transfer rollers 16 are rotated by a drive force of a drive motor that rotate the photosensitive drums 71, resulting in forming a color toner image on the intermediate transfer belt 11.

The secondary transfer roller 12 applies a secondary transfer bias having a polarity opposite to that of the color toner image, to the sheet P. Consequently, the color toner image transferred primarily to the intermediate transfer belt 11 is transferred to the sheet P between the secondary transfer roller 12 and the backup roller 15. As a result, a color transfer image is formed on the sheet P.

The fixing part 4 performs a fixation process on the color transfer image that is transferred to the sheet P by the image forming part 3. The fixing part 4 has a heated roller 41 that is heated by a conductive heating element, and a pressure roller 42, which is disposed facing the heated roller 41 and a circumferential surface of which is press-contacted with a circumferential surface of the heated roller 41.

The transfer image that is transferred to the sheet P by the secondary transfer roller 12 in the image forming part 3 is fixed to the sheet P through the fixation process by means of the heat and pressure generated when the sheet P passes through between the heated roller 41 and the pressure roller 42. The sheet P that is subjected to the fixation process is then discharged to the sheet discharge part 5. Furthermore, a conveying roller pair 6 is disposed in an appropriate section between the fixing part 4 and the sheet discharge part 5 in the color printer 1.

The image forming apparatus 1 carries out the above mentioned image forming operation to form images on the sheets P. In the tandem-type image forming apparatus described above, the developers of the respective colors in the developer set are supplied to the developing devices 72 of the units 7M, 7C, 7Y and 7K corresponding to the colors. It is therefore considered that the adhesiveness between the intermediate transfer belt 11 and the toner image formed by the toner within the corresponding color of developer can be uniformed. Consequently, favorable secondary transferability can be exerted and the occurrence of uneven transfer and defective images can be prevented so that favorable images can be formed.

EXAMPLES

The present disclosure is described in detail based on the examples below. Note that the present disclosure is not limited to these examples. Although not particularly limited, the present example describes the case in which a developer set is used in an image forming apparatus that forms toner images of toners of a plurality of colors of the developer set by using the magenta toner contained in the magenta developer of the developer set, the cyan toner contained in the cyan developer, the yellow toner contained in the yellow developer, and the black toner contained in the black developer, in this order.

Examples 1 to 4, Comparative Examples 1 to 4

Binder Resin

First, a method for manufacturing the binder resin is described.

Polyoxyethylene (2.2)-2,2-bis(4-hydroxyphenyl)propane in an amount of 1.0 mol, terephthalic acid in an amount of 4.5 mol, and trimellitic acid anhydride in an amount of 0.5 mol were put in a reaction container along with a 4 g of dibutyltin oxide, which was reacted for eight hours at 230° C. under a nitrogen atmosphere. Subsequently, the unreacted element was subjected to vacuum distillation under a condition of 8.3 kPa, cleansed, and dried. As a result, a polyester resin with a softening point of 120° C. was obtained. The obtained polyester resin was used as the binder resin.

(Magenta Toner)

First, 100 parts by mass of the polyester resin as the binder resin, 4 parts by mass of quinacridone pigment (C. I. pigment red 122, manufactured by Sanyo Color Works, Ltd.) as the colorant, 10 parts by mass of carnauba wax (carnauba No. 1, manufactured by S. Kato & Co.) as the wax, and 3 parts by mass of quaternary ammonium salt compound (FCA201PS, manufactured by Fujikurakasei Co., Ltd.) as the charge-controlling agent were mixed together using a Henschel Mixer™ (FM20B, manufactured by Nippon Coke & Engineering Co., Ltd.). Thereafter, the obtained mixture was molten and kneaded at 150° C. using a twin-screw extruder (TEM45, manufactured by Toshiba Machine Co., Ltd.), and thus obtained kneaded product was cooled. The cooled kneaded product was coarsely pulverized using a feather mill (350×600 type, manufactured by Hosokawa Micron Co., Ltd.), finely pulverized using an air stream pulverizer (jet mill IDS-2 type, manufactured by Nippon Pneumatic Mfg. Co., Ltd.), and then subjected to a classification process using an elbow jet classifier (EJ-LABO, manufactured by Nittetsu Mining Co., Ltd.). As a result, toner base particles having a volume-average particle diameter of 7 μm were obtained. Note that the volume-average particle diameter of the toner base particles was measured using a particle size analyzer (Multisizer 3, manufactured by Beckman Coulter Inc.).

Next, as the external additive, the silica particles shown in Table 1 (sample manufactured by Cabot Japan K.K) and 0.5 parts by mass of titanium-oxide particles (CR-EL, manufactured by Ishihara Sangyo Kaisha Ltd.) were added to the 100 parts by mass of the obtained toner base particles, and thus obtained product was mixed using the Henscel mixer (FM20B, manufactured by Nippon Coke & Engineering Co., Ltd.). The silica particles are, specifically, small-diameter silica particles with a predetermined particle diameter and large-diameter silica particles with a predetermined particle diameter that are shown in Table 1. These particles were added in the contents shown in Table 1. As a result, the magenta toner (toner base particles having the external additive added externally thereto) was obtained.

(Cyan Toner)

The cyan toner was manufactured in the same way as the magenta toner described above, except that 3 parts by mass of phthalocyanine pigment (C.I. pigment blue 15:1, manufactured by Sanyo Color Works, Ltd.) was used in place of the 4 parts by mass of quinacridone pigment (C.I. pigment red 122, manufactured by Sanyo Color Works, Ltd.). It should be noted the silica particles with the particle diameters shown in Table 1 were used as the external additive in the contents shown in Table 1.

(Yellow Toner)

The yellow toner was manufactured in the same way as the magenta toner described above, except that azo pigment (C.I. pigment yellow 180, manufactured by Sanyo Color Works, Ltd.) was used in place of the quinacridone pigment (C.I. pigment red 122, manufactured by Sanyo Color Works, Ltd.). It should be noted the silica particles with the particle diameters shown in Table 1 were used as the external additive in the contents shown in Table 1.

(Black Toner)

The black toner was manufactured in the same way as the magenta toner described above, except that carbon black (REGAL 330R, manufactured by Cabot Specialty Chemicals, Inc.) was used in place of the quinacridone pigment (C.I. pigment red 122, manufactured by Sanyo Color Works, Ltd.). It should be noted the silica particles with the particle diameters shown in Table 1 were used as the external additive in the contents shown in Table 1.

(Toner Set)

The toners of the respective colors were obtained as described above, and consequently the toner set was also obtained.

TABLE 1

| | | AVERAGE PRIMARY PARTICLE DIAMETER (nm) | | CONTENT (PARTS BY MASS) | | AVERAGE PARTICLE DIAMETER | | | |
|---|---|---|---|---|---|---|---|---|---|
| | | SMALL-DIAMETER PARTICLES $N_1$ | LARGE-DIAMETER PARTICLES $N_2$ | SMALL-DIAMETER PARTICLES $C_1$ | LARGE-DIAMETER PARTICLES $C_2$ | OF TONER BASE PARTICLES R (μm) | $N_2 - N_1$ | $C_1R/N_1$ | $C_2R/N_2$ |
| EXAMPLE 1 | MAGENTA | 10 | 70 | 1.0 | 0.5 | 7 | 60 | 0.70 | 0.050 |
| | CYAN | 10 | 65 | 1.0 | 0.5 | 7 | 55 | 0.70 | 0.054 |
| | YELLOW | 10 | 50 | 1.0 | 0.5 | 7 | 40 | 0.70 | 0.070 |
| | BLACK | 10 | 40 | 1.0 | 0.5 | 7 | 30 | 0.70 | 0.088 |
| EXAMPLE 2 | MAGENTA | 10 | 70 | 1.4 | 0.8 | 7 | 60 | 0.98 | 0.080 |
| | CYAN | 10 | 65 | 1.4 | 0.8 | 7 | 55 | 0.98 | 0.086 |
| | YELLOW | 10 | 50 | 1.4 | 0.8 | 7 | 40 | 0.98 | 0.112 |
| | BLACK | 10 | 40 | 1.4 | 0.8 | 7 | 30 | 0.98 | 0.140 |
| EXAMPLE 3 | MAGENTA | 20 | 80 | 2.0 | 0.6 | 7 | 60 | 0.70 | 0.053 |
| | CYAN | 20 | 70 | 2.0 | 0.6 | 7 | 50 | 0.70 | 0.060 |
| | YELLOW | 20 | 65 | 2.0 | 0.6 | 7 | 45 | 0.70 | 0.065 |
| | BLACK | 20 | 50 | 2.0 | 0.6 | 7 | 30 | 0.70 | 0.084 |
| EXAMPLE 4 | MAGENTA | 20 | 80 | 2.8 | 1.0 | 7 | 60 | 0.98 | 0.088 |
| | CYAN | 20 | 70 | 2.8 | 1.0 | 7 | 50 | 0.98 | 0.100 |
| | YELLOW | 20 | 65 | 2.8 | 1.0 | 7 | 45 | 0.98 | 0.108 |
| | BLACK | 20 | 50 | 2.8 | 1.0 | 7 | 30 | 0.98 | 0.140 |
| COMPARATIVE EXAMPLE 1 | MAGENTA | 10 | 40 | 1.0 | 0.5 | 7 | 30 | 0.70 | 0.088 |
| | CYAN | 10 | 40 | 1.0 | 0.5 | 7 | 30 | 0.70 | 0.088 |
| | YELLOW | 10 | 40 | 1.0 | 0.5 | 7 | 30 | 0.70 | 0.088 |
| | BLACK | 10 | 40 | 1.0 | 0.5 | 7 | 30 | 0.70 | 0.088 |
| COMPARATIVE EXAMPLE 2 | MAGENTA | 10 | 70 | 1.4 | 1.0 | 7 | 60 | 0.98 | 0.100 |
| | CYAN | 10 | 65 | 1.4 | 1.0 | 7 | 55 | 0.98 | 0.108 |
| | YELLOW | 10 | 40 | 1.4 | 1.0 | 7 | 30 | 0.98 | 0.175 |
| | BLACK | 10 | 50 | 1.4 | 1.0 | 7 | 40 | 0.98 | 0.140 |
| COMPARATIVE EXAMPLE 3 | MAGENTA | 20 | 90 | 2.0 | 0.6 | 7 | 70 | 0.70 | 0.047 |
| | CYAN | 20 | 90 | 2.0 | 0.6 | 7 | 70 | 0.70 | 0.047 |
| | YELLOW | 20 | 65 | 2.0 | 0.6 | 7 | 45 | 0.70 | 0.065 |
| | BLACK | 20 | 50 | 2.0 | 0.6 | 7 | 30 | 0.70 | 0.084 |
| COMPARATIVE EXAMPLE 4 | MAGENTA | 20 | 50 | 2.8 | 1.0 | 7 | 30 | 0.98 | 0.140 |
| | CYAN | 20 | 40 | 2.8 | 1.0 | 7 | 20 | 0.98 | 0.175 |
| | YELLOW | 20 | 30 | 2.8 | 1.0 | 7 | 10 | 0.98 | 0.233 |
| | BLACK | 20 | 30 | 2.8 | 1.0 | 7 | 10 | 0.98 | 0.233 |

(Developer Set)

Each of the toners obtained as described above was blended with carrier used in a printer manufactured by Kyocera Mita Corporation (FS-05300DN) to obtain a toner density of 11 percent by mass. Then, the obtained product was agitated for 30 minutes in a ball mill manufactured by Kyocera Mita Corporation. As a result, developer corresponding to each color was obtained, and consequently the developer set was also obtained.

[Evaluation]

The obtained toner set and developer set were evaluated using the following methods.

(Ununiformity of Image Density)

First, image formation was carried out under a normal temperature and normal humidity environment at temperatures between 20 to 23° C., with a relative humidity of 50 to 65% RH, by using the printer manufactured by Kyocera Mita Corporation (FS-C5300DN) as an evaluation machine, the developers of the respective colors in the obtained developer set as start developers, and the toners of the respective colors in the obtained toner set as replenishment toners. The following evaluations were performed.

Specifically, first, the start developers were set in the developer housing parts of the evaluation machine that correspond to the colors. The evaluation machine was turned on and stabilized. Thereafter, a sample image with a 100% solid section, 50% halftone section, character section and thin line section was output. Note that this image was obtained as an initial image. Subsequently, one hundred copies of the same image were output. The $100^{th}$ image from the initial image was rendered as an evaluation image.

Variation in image density in the solid section and halftone section of the evaluated image was observed visually. When a variation was confirmed in the observed image densities, the result was marked with "C." When a small variation was confirmed, the result was marked with "B." When no variation was confirmed, the result was marked with "A."

(White Spots)

The presence/absence of white spots in the solid section of the evaluated image was confirmed visually. When no white spots were confirmed, the result was marked with "A." When white spots were confirmed, the result was marked with "B."

(Void in Thin Lines)

The presence/absence of void (central blurs) in the thin line section of the evaluated image was confirmed visually by using a ×10 loupe. When no void was confirmed, the result was marked with "A." When void was slightly confirmed, the result was marked with "B." When void was confirmed, the result was marked with "C."

The results of each evaluation are shown in Table 2.

TABLE 2

| | UNUNIFORMITY OF IMAGE DENSITY | WHITE SPOTS | VOID IN THIN LINES |
|---|---|---|---|
| EXAMPLE 1 | A | A | A |
| EXAMPLE 2 | A | A | A |
| EXAMPLE 3 | A | A | A |
| EXAMPLE 4 | A | A | A |
| COMPARATIVE EXAMPLE 1 | C | A | B |
| COMPARATIVE EXAMPLE 2 | C | A | B |
| COMPARATIVE EXAMPLE 3 | B | B | B |
| COMPARATIVE EXAMPLE 4 | C | A | C |

As is clear from Table 1 and Table 2, when using the developer set, which has the toner set in which the external additive added externally to the toner base particles includes the small-diameter silica particles and the large-diameter silica particles that are larger than the small-diameter silica particles and become small gradually in the order in which the toner images are transferred (Examples 1 to 4), the ununiformity (unevenness) of the image density, white spots, and void in the thin lines were less obvious in the formed image, compared to a case where the developer set such as those of Examples 1 to 4 was not used (Comparative Examples 1 to 4). Therefore, using the developer set according to the examples can prevent the occurrence of uneven transfer and defective images, whereby favorable images can be formed.

The present specification discloses the technologies with various aspects, as described above. The main technologies are summarized as follows.

One aspect of the present disclosure is a toner set, which is composed of toners of a plurality of colors that are used in an image forming method for forming an image by forming a color toner image using the toners of a plurality of colors and transferring the formed color toner image onto a recording medium, wherein each of the toners of a plurality of colors includes toner base particles that contain a binder resin and a colorant, as well as an external additive that is externally added to the toner base particles, the external additive includes small-diameter silica particles and large-diameter silica particles larger than the small-diameter silica particles, and wherein when, of the toners of a plurality of colors, three color toners to be used consecutively for forming the toner image are defined as a first toner, second toner and third toner respectively in order of usage, an average particle diameter of the large-diameter silica particles contained in the second toner is smaller than an average particle diameter of the large-diameter silica particles contained in the first toner and is larger than an average particle diameter of the large-diameter silica particles contained in the third toner.

This configuration can achieve a toner set composed of toners of a plurality of colors, which is capable of preventing the occurrence of uneven transfer and defective images to form favorable images.

This is due to the following reasons.

First, the small-diameter silica particles can enhance the toner flulidity and transferability of the primary transfer (primary transferability). Thus, favorable toner images can be formed on the intermediate transfer belt and the like. In other words, the developability can be enhanced and sufficient image density can be ensured.

Moreover, the particle diameters of the large-diameter silica particles contained in each toner are changed according to the order in which toner images are transferred, as described above, whereby the transferability of secondarily transferring the toner images of the plurality of toners formed on the intermediate transfer belt or the like, to a recording medium and the like (secondary transferability) can be improved.

By concurrently using the small-diameter silica particles and the large-diameter silica particles, not only the toner fluidity, primary transferability and developability, but also the secondary transferability can be improved.

Specifically, out of the three consecutive toners for transferring the toner images sequentially, the particle diameter of the large-diameter silica particles that is contained in the first toner configuring to form the first toner image is largest, but, thereafter, the particle diameters of the large-diameter silica particles become gradually small in accordance with the order in which the toner images are transferred. In other words, the particle diameter of the large-diameter silica particles contained in the first toner is the largest, and the particle diameter of the large-diameter silica particles contained in the third toner is the smallest.

Out of the three toners, the first toner is used first to transfer a toner image, and is then applied with pressure when toner images are transferred by means of the second toner and the third toner. It is therefore considered that the toner image formed by the first toner adheres most tightly to the intermediate transfer belt. Out of the three toners, the third toner used for forming the last toner image is considered to have the lowest adhesiveness of the toner image with to intermediate transfer belt.

Because the first toner contains the largest large-diameter silica particles, the toner image can be prevented from adhering excessively tightly to the intermediate transfer belt. In addition, since the third toner contains the smallest large-diameter silica particles, the adhesiveness of the toner image with the intermediate transfer belt can be somewhat prevented from decreasing. In other words, regardless of the order in which the toner images are transferred, the adhesiveness of the toner image can be made uniform.

Thus, the order in which the toner images are transferred is unlikely to generate a difference in the adhesiveness of the toner image, and consequently the secondary transferability can be enhanced.

Due to the facts described above, a toner set composed of toners of a plurality of colors, which is capable of preventing the occurrence of uneven transfer and defective images to form favorable images, can be obtained.

This application is based on Japanese Patent application serial No. 2009-245351 filed in Japan Patent Office on Oct. 26, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A toner set, which is composed of toners of a plurality of colors that are used in an image forming method for forming an image by forming a toner image using the toners of a plurality of colors and transferring the formed toner image onto a recording medium, wherein each of the toners of a plurality of colors includes toner base particles that contain a binder resin and a colorant, as well as an external additive that is externally added to the toner base particles, the external additive includes small-diameter silica particles and large-diameter silica particles larger than the small-diameter silica particles, and wherein when, of the toners of a plurality of colors, three color toners to be used consecutively for forming the toner image are defined as a first toner, second toner and third toner respectively in order of usage, an average particle diameter of the large-diameter silica particles contained in the second toner is smaller than an average particle diameter of the large-diameter silica particles contained in the first toner and is larger than an average particle diameter of the large-diameter silica particles contained in the third toner.

2. The toner set according to claim 1, wherein each of the toners satisfies the following expression (1):

$$30 \leqq N_2 - N_1 \leqq 60 \quad (1)$$

(where $N_1$ represents an average primary particle diameter (nm) of the small-diameter silica particles, and $N_2$ represents an average primary particle diameter (nm) of the large-diameter silica particles).

3. The toner set according to claim 1, wherein each of the toner satisfies the following expression (2):

$$0.7 \leqq C_1 R / N_1 \leqq 1 \quad (2)$$

(where $N_1$ represents an average primary particle diameter (nm) of the small-diameter silica particles, R represents an average particle diameter (μm) of the toner base particles, and $C_1$ represents a mass of the small-diameter silica particles with respect to 100 parts by mass of the toner base particles).

4. The toner set according to claim 1, wherein each of the toners satisfies the following expression (3):

$$0.05 \leqq C_2 R / N_2 \leqq 0.15 \quad (3)$$

(where $N_2$ represents an average primary particle diameter (nm) of the large-diameter silica particles, R represents an average particle diameter (μm) of the toner base particles, and $C_2$ represents a mass of the large-diameter silica particles with respect to 100 parts by mass of the toner base particles).

5. A developer set, which is composed of developers of a plurality of colors, wherein the developers of a plurality of colors have developer containing the first toner of the toner set described in claim 1 and carrier, developer containing the second toner of the toner set and carrier, and developer containing the third toner of the toner set and carrier.

6. An image forming apparatus, comprising:

a plurality of image bearing members that are arranged in a predetermined direction in order to form a toner image by means of toners of different colors onto surfaces of the plurality of image bearing members; and a plurality of developing devices that are disposed facing the image bearing members respectively and supply the toners included in developers to the surfaces of the image bearing members, wherein the developers of the developer set described in claim 5 are employed as the developers to be used in the plurality of developing devices.

* * * * *